United States Patent [19]

Grossbard

[11] 4,118,949

[45] * Oct. 10, 1978

[54] BRILLIANTIZED STEP CUT STONE

[76] Inventor: Henry Grossbard, 552 Beach 132nd St., Belle Harbor, N.Y. 11694

[ * ] Notice: The portion of the term of this patent subsequent to May 3, 1994, has been disclaimed.

[21] Appl. No.: 754,110

[22] Filed: Dec. 27, 1976

Related U.S. Application Data

[63] Continuation-in-part of Ser. No. 690,401, May 27, 1976, Pat. No. 4,020,649.

[51] Int. Cl.[2] ..... A44C 17/00

[52] U.S. Cl. ..... 63/32

[58] Field of Search ..... 63/32; D11/90

[56] References Cited

U.S. PATENT DOCUMENTS

| | | | |
|---|---|---|---|
| 668,318 | 2/1901 | Patton | 63/32 UX |
| 2,207,869 | 7/1940 | Monnier | 63/32 |

*Primary Examiner*—F. Barry Shay

*Attorney, Agent, or Firm*—Hane, Roberts, Spiecens & Cohen

[57] ABSTRACT

A brilliantized step cut diamond has a straight edged polygonal shaped girdle with sides and corner facets; a crown with a table and a table-and-girdle breaks which are faceted; and a pyramidal base having a point culet, a culet break and a girdle break with ridges extending from the culet to the corner of the girdle. A fan with three pairs of triangular halves is disposed symmetrically about each ridge with a triangular facet in each corner of the base having an edge which is colinear with the edge of a corner facet and an apex at a ridge. The angle between the culet break and the plane of the girdle is between 30° and 43°.

5 Claims, 4 Drawing Figures

BRILLIANTIZED STEP CUT STONE

CROSS REFERENCE TO RELATED APPLICATIONS

This application is a continuation-in-part of my application Ser. No. 690,401, filed May 27, 1976, now U.S. Pat. No. 4,020,649 issued May 3, 1977. There are also copending herewith applications Ser. No. 737,895 and 737,896 for designs.

BACKGROUND OF THE INVENTION

The invention pertains to cut stones and more particularly to gem stones such as diamonds.

It is known that the brilliant cut maximizes the fire of a diamond. For this reason such a cut is by far the most popular. However, the cut is the most wasteful of diamond raw material.

On the other hand step cut stones such as square cut diamond and emerald cut diamonds while being more conservative of diamond raw material have none of the fire of brilliant cut diamonds. These facts have been known to the diamond trade for a long time and attempts have been made to devise hybrid cuts to capture the advantages of the square and brilliant cut diamonds.

One such hydrid is shown and described in U.S. Pat. No. 3,796,065 for a stone with an emerald cut crown and a modified brilliant cut base. While such a stone has more brilliance than the conventional square or emerald cut stones it does not approach the brilliance of a brilliant cut stone.

The copending application Ser. No. 690,401 does indeed provide a diamond which is on the one hand more brilliant than the heretofore known conventional or hybrid square or emerald cut diamonds and on the other hand is less wasteful of raw material than conventional brilliant cut diamonds. However, in the course of mounting some of such diamonds it is difficult for the prongs of the mounting to easily engage the diamond on the peaked part of the girdle.

SUMMARY OF THE INVENTION

Accordingly, it is an object of the invention to provide a diamond of the class described which is more easily mountable then such previously known diamonds.

Briefly, the invention contemplates a brilliantized step cut diamond having a straight edged polygonal shaped girdle, a plurality of side facets and corner facets, a crown, and a base. The crown has a girdle break, a table break and a table, the table break being cut with triangular shaped facets and the girdle break being cut with quadrilaterally shaped facets. The base is pyramidal and has a girdle break, a culet break, a culet and a plurality of ridges. Each of the ridges extends from the culet toward a corner. A fan of from one to three pairs of triangular halves and a triangular facet having its base colinear with an edge of a corner facet of the girdle and an apex at the end of a ridge of the pyramid form the faceting at each corner of the base. A kite shaped facet on each side of the base on the culet break disposed between a pair of adjacent fans, and a shield shaped facet on each side of the base on the girdle break form the faceting for the remainder of the base.

BRIEF DESCRIPTION OF THE DRAWING

Other objects, the features and advantages of the invention will be apparent from the detailed description when read with the accompanying drawing which shows by way of example the presently preferred embodiment of the invention wherein.

DESCRIPTION OF THE PREFERRED EMBODIMENT

Figure 1:
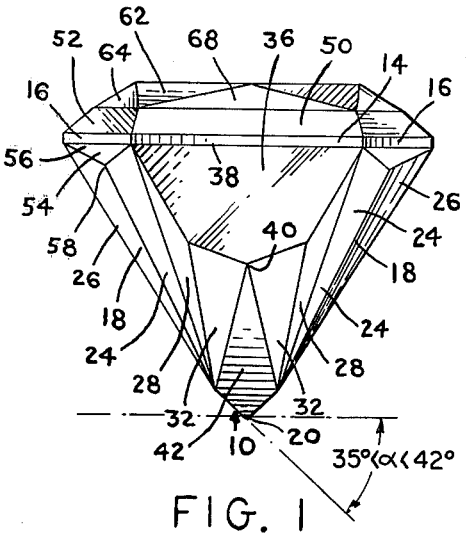
FIG. 1 is a side view of a diamond according to the invention.
Figure 2:
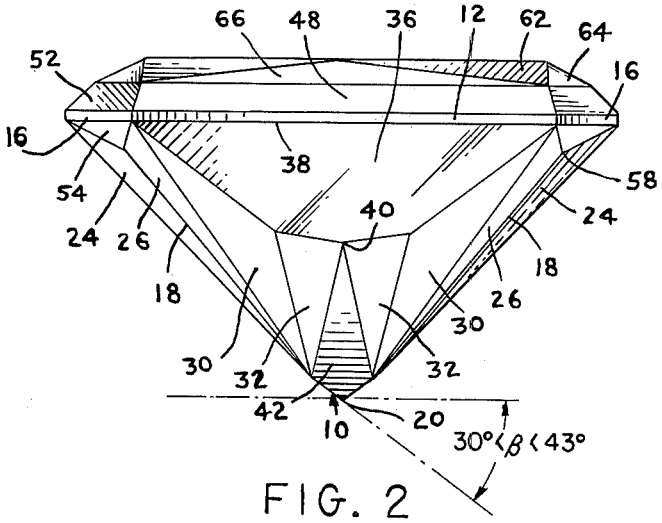
FIG. 2 is the other side view of the diamond of FIG. 1.

The Figures show a step cut diamond 10 having: an octagonal girdle with long side facets 12, short side facets 14 and corner facets 16; a pyramidal base having ridge lines 18, a girdle break, a culet break and a culet 20; and a crown having a girdle break, a table break and a table 22. The two breaks of the crown should be of approximately equal length. In addition, the angle between the plane of the girdle break of the crown and the table should be in the range from 28° to 48° .

The base of the stone is so cut that the girdle break has from 20 to 40 percent of the volume of the base with the culet break the remainder. Thus the angle between the plane of the table and the plane of the girdle break is from 40° to 60°. On the long side the angle $\alpha$ between the plane of the culet break and the plane of the table is from 35° to 42°. However, since the culet must be in the direct center of the base the angle $\beta$ between the plane of the culet break on the short side and the plane of the table can be as large as 43° if the original stone is square to as low as 30° for oblong stones.

Figure 4:
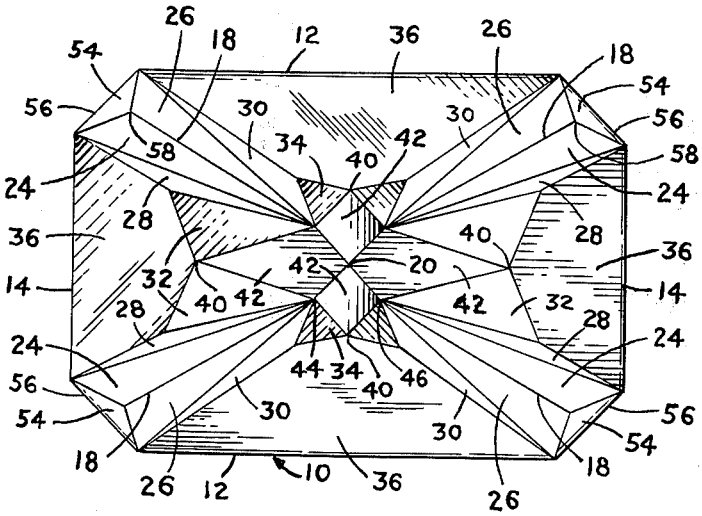
FIG. 4 is a bottom view of the diamond of FIG. 1.

The base is cut with a fan of from one to three pairs of halves cut symmetrically about each ridge line 18. As shown in FIG. 4 three pairs of halves are disposed symmetrically about each ridge line, this being the most preferred number of pairs. More specifically, the first pair comprises halves 24 and 26, the second pair comprises halves 28 and 30 and the third pair comprises halves 32 and 34. After the cutting of the fans, there is left in each side of the base girdle break a shield facet 36 with a base 38 colinear with the girdle, and an apex 40. There is also left in each side of the culet break a kite facet 42. Each kite facet has one point in contact with an apex 40, a diagonally opposite point at the culet 20 and a pair of diagonally opposite points 44 and 46 at the radii of different fans. Finally, it should be noted that when looking directly down into the diamond from the table, the apex 40 of each shield facet 36 is not visible or at most just barely protruding into view.

Figure 3:
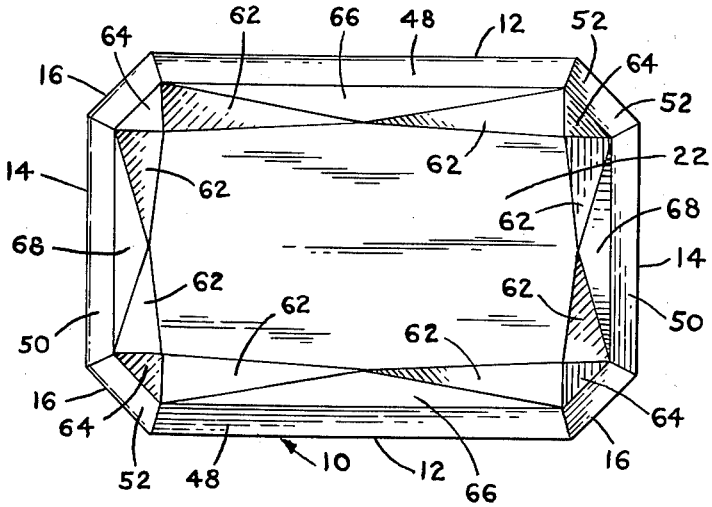
FIG. 3 is a top view of the diamond of FIG. 1.

The crown of the diamond 10 as best seen in FIG. 3 is cut with a pair of star facets into each side of the table break. Thus the table break eight are the star facets 62, four are triangular facets 64 in the corners, two are triangular facets 66 in the long sides and two are triangular facets 68 in the short sides. The girdle break of the crown has four "rectangular" facets 48, 50 on the long and short sides respectively and the "rectangular facets" 52 at the corners.

In order to provide easy mounting of the diamond in a setting the triangular facets 54 are provided in each corner of the base. The baseline 56 of each of these triangular facets is colinear with a side of the adjacent corner facet 16 of the girdle and the apex 58 terminates at a ridge line 18.

While only a single embodiment of the invention has been shown and described in detail there will now be obvious to those skilled in the art many modifications and variations satisfying many or all of the objects of the invention but which do not depart from the spirit thereof as defined by the appended claims. For example, although there has been shown only a rectangular cut stone, the invention contemplates any straight edged polygon stone such as regular or irregular hexagonal stones, truncated kite shaped stones, pentagons, etc.

What is claimed is:

1. A brilliantized step cut diamond comprising: a straight edged polygonal shaped girdle with a plurality of side facets and corner facets; a crown, said crown having a girdle break, a table break and a table, said table break being cut with triangular shaped facets and said girdle break being cut with quadrilaterally shaped facets; and a pyramidal base, said pyramidal base having a girdle break, a culet break, a point culet and a plurality of ridges, each of said ridges extending from said culet toward a corner of said girdle, a fan of at least three pairs of triangular halves symmetrically disposed about each ridge of the pyramidal base, a kite shaped facet on each side of the base on the culet break and disposed between a pair of adjacent fans, and a shield shaped facet on each side of the base in the girdle break, each shield shaped facet having a base line parallel to the girdle and an apex in contact with a point of the associated kite shaped facet, and a triangular facet at each corner of the base, each of said triangular facets having an edge colinear with the edge of the adjacent corner facet of the girdle and an apex at said ridge.

2. The brilliantized step cut diamond of claim 1 wherein said girdle and said table have oblong substantially rectangular shapes with two wide sides and two narrow sides.

3. The brilliantized step cut diamond of claim 1 wherein said kite shaped facets make an angle of between 30° and 43° with the girdle plane.

4. The brilliantized step cut diamond of claim 3 wherein the kite shaped facets on the wide sides of base form an angle of between 35° and 42° and the kite shaped facets on the narrow side of the base form an angle which is less than 43° but greater than 30°.

5. The brilliantized step cut diamond of claim 1 wherein the girdle break of the crown makes an angle of 28° to 48° with the plane of the girdle.

* * * * *